US009970268B2

(12) United States Patent
Ireland et al.

(10) Patent No.: US 9,970,268 B2
(45) Date of Patent: May 15, 2018

(54) APPARATUS AND METHODS FOR ORIENTED-FRACTURING OF FORMATIONS

(71) Applicants: Kelly D. Ireland, Conroe, TX (US); Robert A. Estes, Tomball, TX (US)

(72) Inventors: Kelly D. Ireland, Conroe, TX (US); Robert A. Estes, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 802 days.

(21) Appl. No.: 14/475,009

(22) Filed: Sep. 2, 2014

(65) Prior Publication Data

US 2016/0061011 A1 Mar. 3, 2016

(51) Int. Cl.

| | |
|---|---|
| ***E21B 43/04*** | (2006.01) |
| ***E21B 43/14*** | (2006.01) |
| ***E21B 43/26*** | (2006.01) |
| ***E21B 43/12*** | (2006.01) |

(52) U.S. Cl.
CPC ..... *E21B 43/04* (2013.01); *E21B 43/126* (2013.01); *E21B 43/14* (2013.01)

(58) Field of Classification Search
CPC ..... E21B 43/04; E21B 43/14; E21B 43/26; E21B 43/25
See application file for complete search history.

(56) References Cited

U.S. PATENT DOCUMENTS 4,779,681 A * 10/1988 York ..... E21B 33/1291 166/100
2014/0151037 A1* 6/2014 Morgan-Smith ..... E21B 47/024 166/255.2

* cited by examiner

*Primary Examiner* — Wei Wang
(74) *Attorney, Agent, or Firm* — Cantor Colburn LLP

(57) ABSTRACT

In one aspect, an apparatus for treating a formation is disclosed that in one non-limiting embodiment includes a first string for placement in the wellbore that includes a first flow port that enables a treatment fluid to flow from inside the first string to the formation via an annulus between the first string and the formation, a second string for placement in the first string, wherein the second string includes a second flow port that supplies the treatment fluid to the first flow port along a selected radial orientation to direct the treatment fluid in the selected radial direction.

20 Claims, 3 Drawing Sheets

APPARATUS AND METHODS FOR ORIENTED-FRACTURING OF FORMATIONS

BACKGROUND

1. Field of the Disclosure

This disclosure relates generally to apparatus and methods for completing a wellbore for the production of hydrocarbons from subsurface formations, including fracturing, sand packing and flooding formation zones.

2. Background of the Art

Wellbores are drilled in subsurface formations for the production of hydrocarbons (oil and gas). Modern wells are drilled to great well depths, often more than 1500 meters (about 15,000 ft.). Hydrocarbons are found in traps at different depths in subsurface formations. Such sections of the formation are referred to as reservoirs or hydrocarbon-bearing formations or zones. Some formations have high mobility, which is a measure of the ease of hydrocarbon flow from the reservoir into a well drilled through the reservoir under natural downhole pressures. The hydrocarbons trapped in low mobility formations are unable to move with ease from the reservoir into the well. Stimulation methods are typically employed to improve the mobility of the hydrocarbons through such reservoirs. One such method, referred to as hydraulic fracturing (also referred to herein as "fracing" or "fracking"), is often utilized to create cracks in the reservoir to enable the fluid from the formation (formation fluid) to flow into the wellbore. In hydraulic fracing, a treatment fluid (also referred to as the "frac fluid," which typically is a mixture of water and an additive, such as guar, and a proppant, such as synthetic sand) is supplied under pressure to create cracks in the formation and to fill such cracks with the proppant. Such a method is also referred to herein as frac/pac.

To fracture a zone, an assembly containing an outer string (also referred to herein as the "permanent string") with an inner string (also referred to herein as the "service string" or the "running tool") therein is run in or deployed in the wellbore, wherein the wellbore may be an open hole or cased hole. The outer string typically includes a sleeve port that allows the frac fluid to flow to the annulus between the outer string and the perforations in the wellbore. The inner string includes devices attached to a tubing to operate various devices in the outer string and a port or device commonly referred to as the "frac port" that allows the frac fluid supplied from the surface under pressure to flow from the inner string to the perforations via the frac sleeve.

Frac ports typically contain a number of radial openings that supply the treatment fluid across the sleeve port, which also has multiple radial openings. In such port configurations, the frac fluid flows around the entire circumference of the outer string at same pressure. In some formations, it may be desirable to direct the supplied frac fluid in a particular direction to cause fractures along such radial direction to enhance fracturing. In horizontal wells, it may be desirable to fracture the formation along the high side of the wellbore for enhanced recovery of oil from such zones.

The present disclosure provides apparatus and methods for orienting a frac port along a desired radial direction for the treatment of wellbore.

SUMMARY

In one aspect, an apparatus for treating a formation is disclosed that in one non-limiting embodiment includes a first string for placement in the wellbore that includes a first flow port that enables treatment fluid to flow from inside the first string to the formation via an annulus between the first string and the formation, a second string for placement in the first string, wherein the second string includes a second flow port that supplies the treatment fluid to the first flow port, and a second port orientation device for orienting the second port in the wellbore to direct the treatment fluid in a selected radial direction.

In another aspect, a method of treating a formation surrounding a wellbore is disclosed that includes: placing a first string in the wellbore, the first string including a first flow port that enables a treatment fluid to flow from inside the first string to the formation via an annulus between the first string and the formation; placing a second string inside the first string, the second string including a second flow port for supplying the treatment fluid to the first flow port; orienting the second port along a selected radial direction; and supplying the treatment fluid under pressure to the second port to supply the treatment fluid to the first port to treat the formation with the treatment fluid along the selected radial direction.

Examples of the more important features certain apparatus and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
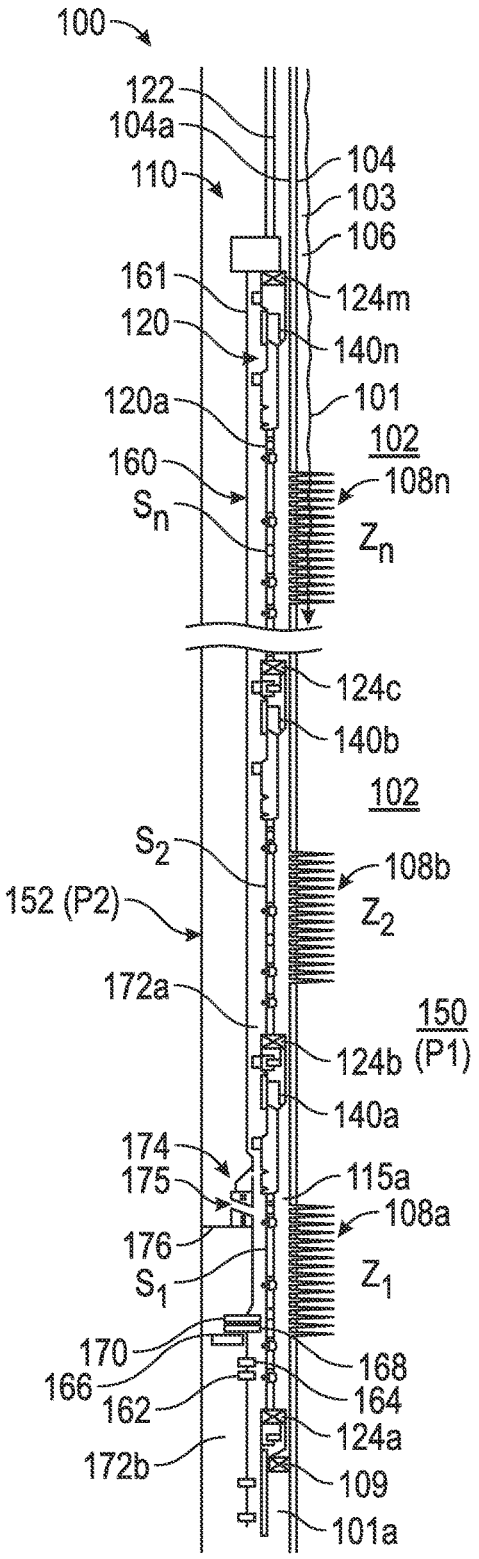
FIG. 1 shows an exemplary multi-zone wellbore system that has an assembly deployed therein that includes an outer string having a sleeve valve and an inner string having a frac port, wherein the frac port and/or the sleeve valve may be oriented along a selected radial direction for supplying the treatment fluid in such radial direction.

FIG. 1 is a line diagram of a section (lower completion section) of a well or wellbore system 100 that includes a well or wellbore 101 formed in a formation 102 for performing a treatment operation therein, such as fracturing the formation 102 (also referred to herein as fracing or fracking), gravel packing, water flooding, etc. The wellbore 101 is lined with a casing 104, such as a string of jointed metal pipe sections, known in the art. The space or annulus 103 between the casing 104 and the wellbore 101 is filled with cement 106. In an alternative embodiment, the wellbore 101 may be an open hole. The particular embodiment of FIG. 1 may be utilized for selectively fracking one or more zones in any selected or desired sequence or order or all zones simultaneously. The wellbore 101 is shown to include multiple zones Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages into the formation 102 for fracturing production zone Z1-Zn. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101.

After casing, cementing, perforating and sump packer 109 deployment, the zones Z1-Zn are ready for treatment operations. Although the wellbore system 100 is described in reference to fracturing and sand packing production zones, the apparatus and methods described as described herein or with obvious modifications may also be utilized for other well treatment operations, including, but not limited to, gravel packing and water flooding. In FIG. 1, the wellbore is shown as a cased hole; however, apparatus and methods described herein are equally applicable to open holes. The formation fluid 150 resides in the formation 102 at formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and thus prevents blow-outs.

Still referring to FIG. 1, to fracture (treat) one or more zones Z1-Zn, a system assembly 110 is run inside the casing 104. In one non-limiting embodiment, the system assembly 110 includes an outer string 120 (sometimes referred to as the "permanent string") and an inner string 160 (also referred to as the "service string") inside the outer string 120. The outer string 120 includes a pipe 122 and a number of devices associated with each of the zones Z1-Zn for performing treatment operations described in detail below. In one non-limiting embodiment, the outer string 120 includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case, the number of packers in the outer string 120 is one more than the number of zones Z1-Zn. In some cases, the sump packer 109, however, may be utilized as the lower packer 124*a*. In one non-limiting embodiment, the intermediate packers 124*b*, 124*c*, etc. may be configured to be independently deployed in any desired order so as to fracture and pack any of the zones Z1-Zn in any desired order. In other embodiments, some or all the packers may be configured to be deployed at the same or substantially the same time. Packers 124*a*-124*m* may be hydraulically set, mechanically set or by any other method known in the art. The lower packer 124*a* and intermediate packer 124*b*, when deployed, will isolate zone Z1 from the remaining zones, packers 124*b* and 124*c* will isolate zone Z2 and so on.

The outer string 120 further includes a screen (also referred to as "sand screen") adjacent to each zone that prevents flow of solid particles above a certain size from passing through the screen. For example, screen S1 is shown placed adjacent to zone Z1, screen S2 adjacent zone Z2 and screen Sn adjacent to zone Zn. The outer string 120 also includes, for each zone, a flow control device, such as a sleeve valve, (also sometimes referred to as a "flow port", "slurry outlet", "gravel exit" or "frac sleeve"), which may be sliding sleeve valve or another valve, uphole or above its corresponding screen to provide fluid communication between the inside 120*a* of the outer string 120 and its associated zone. As shown in FIG. 1, a sleeve valve 140*a* (also referred to as a flow port) is provided for zone Z1 between screen S1 and its intermediate packer 124*b*, sleeve valve 140*b* for zone Z2 and sleeve valve 140*n* for zone Zn. In one embodiment, a sleeve valve is configured to provide radial opening all around the outer assembly 102. In another embodiment, a sleeve valve is configured to include a single port or outlet that covers a selected radial angle or portion (for example less than 30 percent or less than 50 percent) and thus provides a fluid opening only corresponding to certain radial section of the wellbore 101. In another embodiment, two opposing openings may be provided, each covering a certain radial portion or section, for example less than 30 percent, of the outer periphery of the outer string 120. Other suitable configurations may also be utilized. Typically, the outer string 120 is run-in the well 101 with the sleeve valves 140*a*-140*n* closed, as shown in FIG. 1, so no fluid can flow from the inside 120*a* of the outer string 120 to any of the zones Z1-Zn until such outlets are opened downhole.

Still referring to FIG. 1, the inner string 160 includes a metallic pipe or tubular 161 for conveying a number of devices inside the outer string 120 to perform a variety of operations, such as setting the packers, opening and closing valves, shifting sleeves and supplying a fluid 152 from the inner string 160 to the formation zones Z1-Zn via the sleeve valves 140*a*-140*n*. The inner string 160 is further shown to include an opening shifting tool 162 for opening a sleeve valve, a closing shifting tool 164 for closing a sleeve valve, reversing valve 166 that enables the removal of the treatment fluid from the wellbore after treating each zone, and an up-strain locating tool 168 for locating a location or element in the outer string 120 when the inner string 160 is pulled uphole, and a set down tool or set down locating tool 170 to set down the inner string 120 in the outer string 160 at selected locations. In one aspect, the set down tool 170 may be configured to locate each zone and then set down of the inner string at each such location for performing a treatment operation. Such devices are known in the art and are thus not described in detail herein. The inner string 160 further includes a crossover tool 174 (also referred to herein as a "frac port" or "flow port") for providing a fluid path 175 between the inner string 160 and the sleeve valves 140*a*-140*n* in the outer string 120. In one embodiment, the frac port opening 175 covers or opens a portion of outer surface of the inner string, such as less than 50 percent. In another embodiment, two opposing openings may be provided, each covering a portion, such as less than 30 percent. In yet another embodiment, the opening 175 may provide fluid from substantially or all around the inner string to the sleeve valves. In practice, when the sleeve valve includes restricted opening, such as opening a section of the outer string to the formation, the frac port with openings all around may be utilized for treatment. When the sleeve valve provides an opening substantially all around the outer string, the frac port with a restricted opening may be orienting along a selected radial direction for treatment of the formation. In one aspect, the frac port 174 also includes flow passages 176 therethrough, which passages may be gun-drilled through the frac port 174 to provide fluid communication between space 172*a* between the inner string 160 and the outer string 120 and space 172*b* below the frac port 174 in the inner string 160. The passages 176 provide fluid flow and thus pressure communication between spaces 172*a* and 172*b*. In one embodiment, the frac port 174 includes a port that can be aligned in a particular radial direction as described in more detail in reference to FIG. 2.

Figure 2:
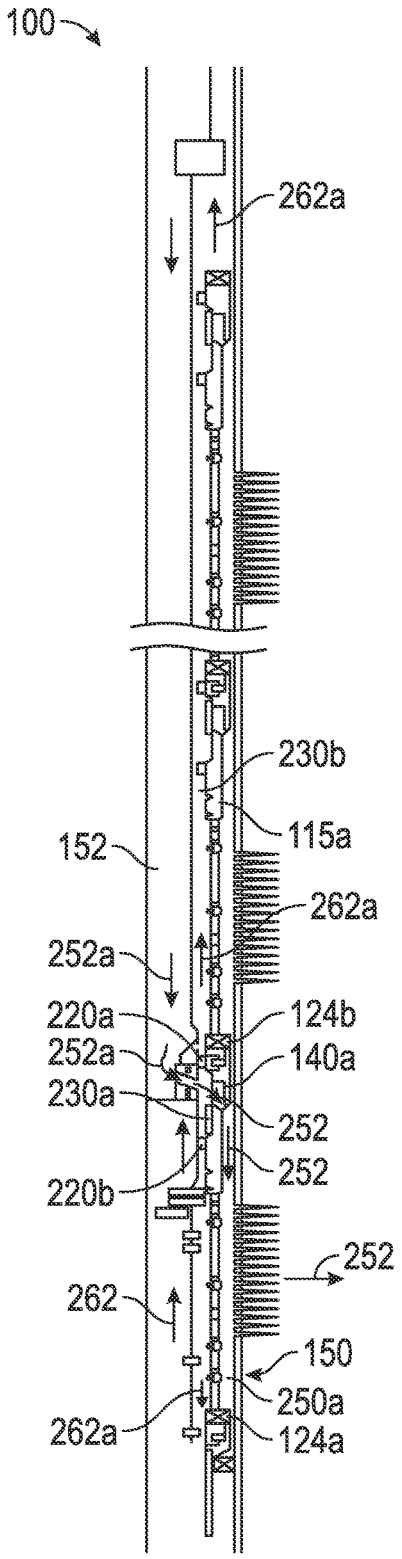
FIG. 2 shows the system of FIG. 1, wherein the frac port and/or the sleeve valve has been aligned along the selected radial direction for treatment of the formation.

Referring now to FIG. 2, to perform a treatment operation in a particular zone, for example zone Z1, such zone, in embodiment is isolated from other zones Z2-Zn. Sleeve valve 140*a* is opened and the frac port opening 175 is aligned along a selected radial direction so that fluid 152*a* is supplied under pressure to the formation, as shown by arrows 252*a*. In the particular configuration of outer string 120, to isolate zone Z1 from the other zones Z2-Zn, packers 124*a* and 124*b* are set or deployed to seal the annulus 115*a* between the packers 124*a* and 124*b*, casing 104 and the inner string 120. The frac port 174 or the inner string 120 is manipulated, as described in more detail in reference to FIG. 3, to align the opening 175 in the desired radial direction. Seals 220*a* and 220*b* are activated to seal the zone 230*a* between the outer string 120 and the inner string 160 to direct the fluid 152 through the sleeve valve 140*a*. The treatment fluid 152 supplied under pressure will travel to the perforations 108*a* as shown by arrows 252, while the return fluid 150 from zone Z1 in formation 102 will travel to the surface via a return valve 250*a* in screen S1 and the inner string 120 via bleed holes 176 and annulus 230*b*, as shown by arrows 262.

Figure 3:
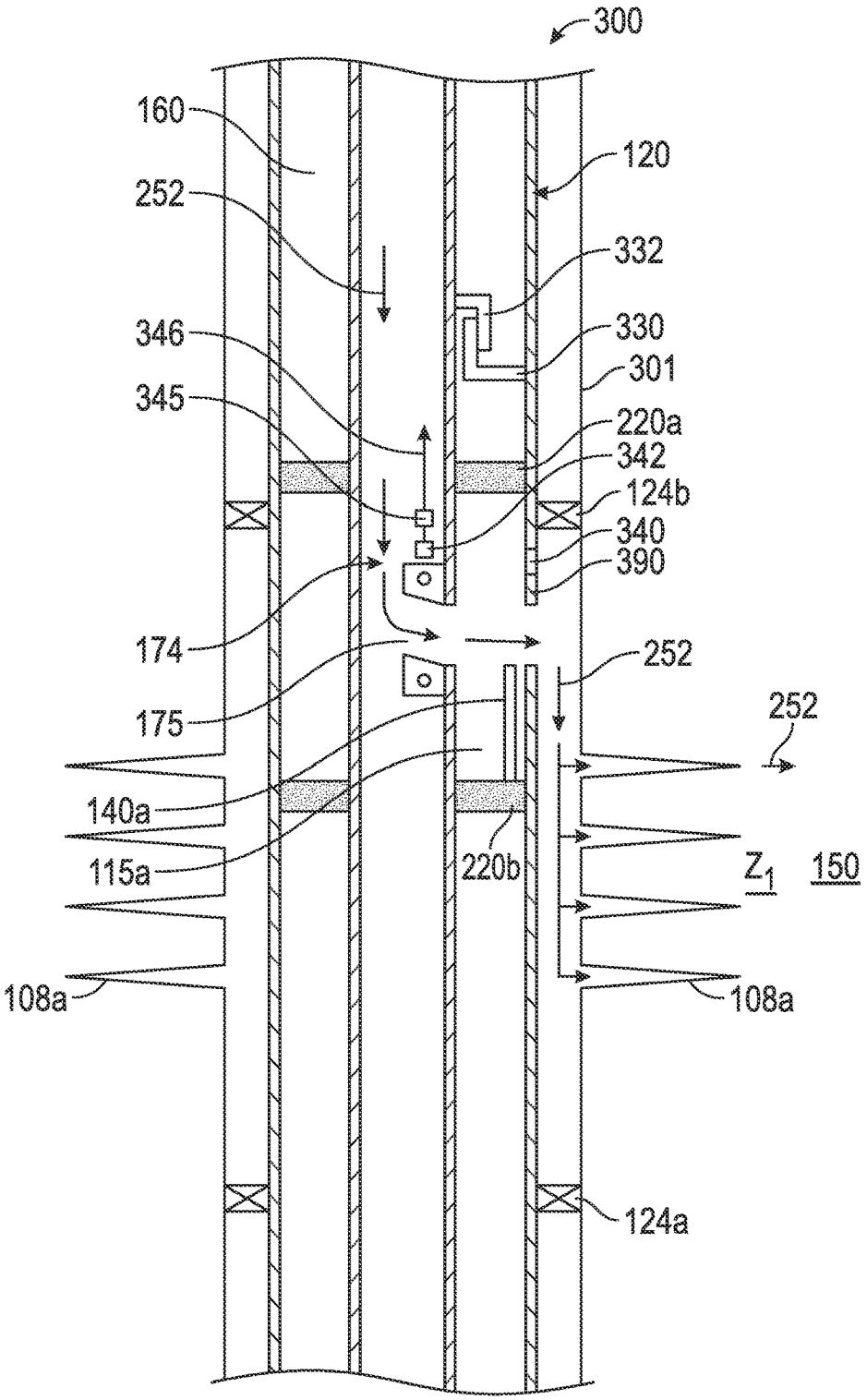
FIG. 3 shows certain details of a frac port in the inner string and devices for orienting the frac port along the selected radial direction.

FIG. 3 shows an open hole wellbore system 300 that includes an open hole 301 and wherein a single frac port opening 175 is aligned along a selected radial direction for treating a production zone Z1. The system 300 is shown to include an outer string 120 and an inner string 160, as described in reference to FIG. 2. The inner string 120 is shown with: the zone Z1 isolated from other zones with the packers 124*a* and 124*b* activated; the sleeve valve 140*a* opened; and the area above and below the sleeve valve 140*a* sealed by seals 220*a* and 220*b* The frac port opening 175 may be aligned along a desired radial direction by any suitable method or mechanism. In one embodiment, a guide 330 may be provided along the inside of the outer string 120 and a corresponding guide 332 in the inner string. The inner string 160 may be manipulated inside the outer string 120 to cause the guide 332 to engage with the guide 330 to cause the frac port opening 175 to align along the radial direction corresponding to the guide 330.

In another embodiment, a magnetic sensor may be utilized to orient the frac port opening 174. In one configuration, a magnetic device or magnet 340 may be placed on an inside of the outer string 120 to provide or generate a magnetic field and a sensor, such as a magnetic pick-up sensor, 342 may be placed on the inner string 160 at a suitable place proximate to the frac port opening 175 to pick-up or detect the magnetic field. To align the frac port opening 175, the inner string 160 is manipulated till the sensor 342 detects the appropriate magnetic field from the magnet 340. A circuit 345 transmits a signal to the surface upon detection of the signal so that an operator can orient the opening along the desired radial direction. The circuit 345 may send a signal via any suitable telemetry method, including, but not limited to, a link 346 (such as a conductor or an optical fiber) run along an inside of the inner string, and an acoustic signal via the fluid in the inner or outer string when a fluid is circulating in the string. Pulsers for generating such acoustic signals in circulating fluid in wellbores are known in the art and thus are not described in detail herein. Flow of the treatment fluid is shown by arrows 252.

Figure 4:
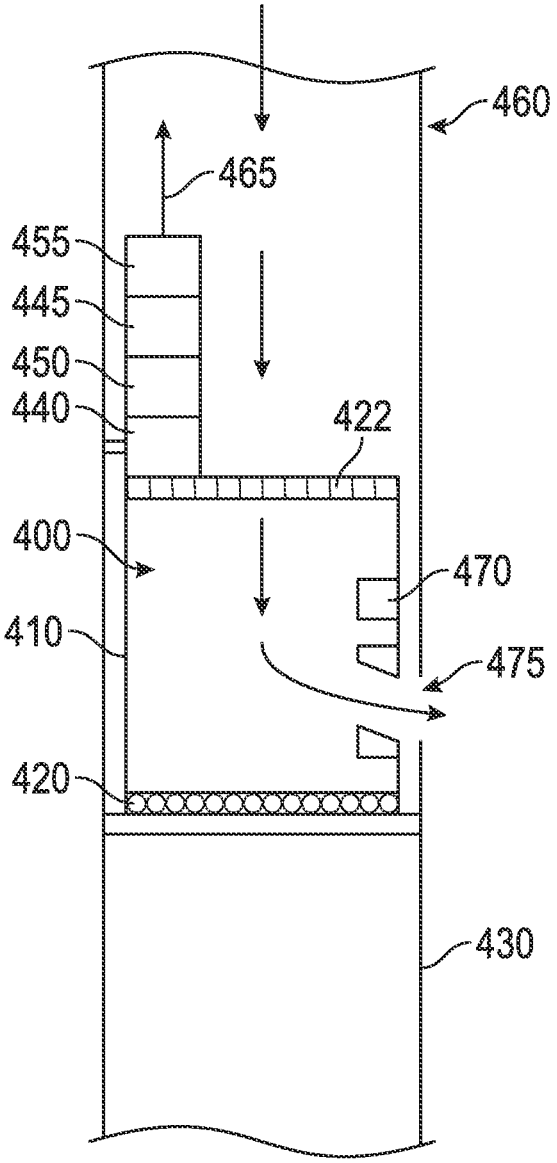
FIG. 4 shows a line diagram of a module configured to orient a frac port opening along any radial direction.

In yet another embodiment, the frac port opening 175 may be configured to rotate in the inner string 160 in response to a command signal from the surface or programmed to rotate according to programmed instruction. FIG. 4 shows a line diagram of a module 400 in an inner string 460 that in one non-limiting embodiment includes a frac port opening 475. A member 410 is supported by bearings 420 inside the tubular 430 of the inner string 460. A motor, such as a stepper motor 440, coupled to a gear mechanism 422 is configured to rotate the member 410 about the bearings 420, this rotation serving to rotate the frac port opening 475. A control circuit 450 containing a processor and electrical circuitry controls the motor 440. A battery pack 455 provides power to the motor 440 and the control circuit 450. Sensors, such a gyroscopes and accelerometers 470, may be utilized to determine the orientation of the frac port opening 475. Gyroscopes provide orientation of the frac port opening 475. Accelerometers provide information about the high side of the wellbore, which can aid in orienting the frac port opening 470 along any desired direction in deviated wellbores. In one aspect, command signals may be sent to the control circuit 450 to cause the motor 440 to orient the frac port opening 475. In another configuration, the processor may be programmed to automatically orient the frac port opening 475. In another aspect, when more than one zone is to be treated, the processor may be programmed to orient the frac port opening along different radial directions. Any suitable telemetry method may be utilized for transmitting signals between a surface location and the control circuit 450. In one aspect, a communication link may be utilized for transmitting signals between the control circuit and a surface location and in another aspect a transmitter/receiver 455 may be utilized to transmit and receive signals wirelessly.

Referring back to FIG. 3, in another aspect, the treatment fluid may be directed along a selected radial direction by providing a sleeve valve, such as sleeve valve 140*a*, that includes an opening that provides a fluid path from a section of the outer string, as described earlier. In such a configuration, the outer string 120 may be placed in the wellbore 101 so that the sleeve valve opening is aligned along the desired radial direction. In one aspect, this may be accomplished by inserting the outer string 120 by orienting the sleeve valve opening along the desired direction. In another aspect, the outer string 120 may be rotated in response to input from one or more sensors in the outer string, such as gyroscopes and accelerometers 390 placed in the outer string 120 proximate to the sleeve valve 140*a* opening. Signals from the sensors 390 may be transmitted via a communication link along the outer string or wirelessly as is known in the art. In such a configuration, the frac port opening may provide omnidirectional fluid flow as the fluid flowing to the formation will be directed along the desired radial direction via the narrower opening in the sleeve valve 140*a*. In yet another aspect, the frac port opening 175 may be directional as described above and such an opening may be aligned in front of the sleeve valve opening in the manner described above. In yet another embodiment, the assembly 110 may be assembled at the surface with the inner string 160 disposed in the outer string 120 with the frac port opening 175 aligned in the desired direction and then inserting such an assembly in the wellbore 101.

Supplying or pumping a treatment fluid, such as slurry, from a single port or opening, such as opening 475 (FIG. 4) or via a directional opening in the sleeve valve, such as valve 140*a*, described in reference to FIG. 3, can direct the slurry in a particular direction. This can concentrate the fluid flow in one area external to the outer string 120 (FIG. 1). If the fracture initiates on a plane not aligned with the single port, the fluid flow may be diverted around an annulus inside the casing or around the outer string of an open hole well system, which can reduce the efficiency of the fracturing operation. If the single frac port or even multiple ports (for example 2 ports located 180 degrees apart) on the inner string are directly aligned with the desired plane of the fracture, then fracture initiation and the growth of such fractures could be improved. The inner string (service tool) (460, FIG. 4) with a single port or multiple ports may be aligned using any method, including sensors utilized in measurements-while-drilling sensors, such as gyroscopes, accelerometers, known in the art. This method provides information at the surface regarding orientation of the frac port opening within a known downhole formation. By rotating the service string, the frac port can be oriented in the desired or selected direction to enhance fracture initiation and growth, thereby improving a stimulation treatment. Thus in aspects, the systems and methods described herein may provide concentration of pressure and proppant flow to create a more efficient fracture pattern for enhanced recovery, compared to present methods in which slurry is pumped through randomly radially oriented openings, which cause the slurry to flow around the casing or the open hole to find the fracture path.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for treating a formation, comprising:

a first string for placement in the wellbore, the first string including a first flow port that enables a treatment fluid to flow from inside the first string to the formation;

a second string for placement in the first string, the second string including a second flow port that supplies the treatment fluid to the first flow port; and an orientation device for orienting the second port in the wellbore along a selected radial direction for supplying the treatment fluid to the first flow port; and a module that rotates the second flow port within the second string, wherein the orientation device includes:

(i) one of an accelerometer and gyroscope, and (ii) a circuit for transmitting a signal corresponding to a signal from the one of the accelerometer and the gyroscope to a remote location.

2. The apparatus of claim 1, wherein the orientation device is selected from a group consisting of:

(i) a first guide associated with the first string and a second guide in the second string for engaging with the first guide in the second string to orient the second flow port along the selected direction; and (ii) a magnetic device on the first string that provides a magnetic field and a sensor on the second string for detecting the magnetic field from the magnetic device.

3. The apparatus of claim 1, wherein the second flow port rotates about bearings in the second string.

4. The apparatus of claim 3 further comprising:

(i) a motor that rotates the second flow port;

(ii) a control circuit for controlling the motor to orient the second flow port along the selected radial direction.

5. The apparatus of claim 4, wherein the control circuit controls the motor in response to one of:

(i) a signal sent from a remote location; and (ii) programmed instructions associated with the control circuit.

6. The apparatus of claim 5 further comprising a telemetry device configured to transmit signals from the control circuit to the remote location as one of:

(i) pressure signals via a fluid in the wellbore;

(ii) electrical signals via an electrical conductor; and (iii) optical signals via a fiber optic link.

7. The apparatus of claim 5, wherein the pressure signals are sent by a device that generates pulses by one of:

(i) by bypassing a fluid circulating in the wellbore to generate negative pressure pulses; and (ii) by blocking a fluid circulating in the wellbore to generate positive pressure signals.

8. The apparatus of claim 1, wherein the first flow port is configured to include multiple openings around the wellbore and the second flow port includes one of:

(i) a single opening that covers less than 30 percent of the radial space of the wellbore; and (ii) two openings substantially opposite to each other, each covering a portion of the wellbore radial section.

9. A method of treating a formation surrounding a wellbore, comprising:

placing a first string in the wellbore, the first string including a first flow port that enables a treatment fluid to flow from inside the first string to the formation;

placing a second string inside the first string, the second string including a second flow port for supplying the treatment fluid to the first flow port;

using a sensor of the second string to determine an orientation of the second flow port, wherein the sensor includes one of an accelerator and a gyroscope;

providing a motor configured to rotate the second flow port;

providing a control circuit configured to control the motor; and controlling the motor to orient the second flow port in response to a signal sent from a surface location or programmed instruction provided to the control circuit for automatically orienting the second flow port along the selected radial direction; and supplying the treatment fluid under pressure to the second port to supply the treatment fluid to the first port to treat the formation.

10. The method of claim 9 further comprising:

orienting the second flow port in the selected direction before supplying the treatment fluid under pressure to the second port.

11. The method of claim 10, wherein determining the orientation of the second flow port in the wellbore comprises:

orienting the second port along the selected radial direction based on the determined orientation of the second flow port.

12. The method of claim 9 further comprising:

(i) providing an orientation device that includes a first guide in the first string and a second guide in the second string for engagement with the first guide to orient the second flow port along the selected radial direction; and (ii) manipulating the second string inside the first string to engage the second guide with the first guide to orient the second flow port along the selected radial direction before supplying the treatment fluid to the second flow port.

13. The method of claim 9 further comprising:

(i) providing a magnetic device on the first string and a magnetic detector on the first string; and (ii) manipulating the second string inside the first string to detect the magnetic device by the magnetic detector; and (iii) orienting the second flow port along the selected direction in response to the detection of the magnetic device.

14. The method of claim 9, wherein the signal is sent via one of:

(i) pressure signals;

(ii) electrical signals via a communication link between the control circuit and the surface location; and (iii) optical signals via a fiber optic link.

15. The method of claim 14, wherein the pressure signals are sent by a device that generates pulses by one of:

(i) by bypassing a fluid circulating in the wellbore to generate negative pressure pulses; and (ii) by blocking a fluid circulating in the wellbore to generate positive pressure signals.

16. The method of claim 9, wherein the first flow port is configured to include multiple openings around the wellbore and the second flow port includes one of:

(i) a single opening that covers a portion of the radial section of the second string; and (ii) two openings substantially opposite to each other, each covering a portion of the radial section of the second string.

17. An apparatus for treating a formation, comprising:

a first string for placement in the wellbore, the first string including a first flow port that enables a treatment fluid to flow from inside the first string to the formation, wherein the first flow port provides an opening that covers a portion of radial portion section of the first string;

a second string placed inside the first string, the second string including a second flow port for supplying the treatment fluid to the first flow port for treating the formation;

an orientation device including one of an accelerometer and a gyroscope for orienting the second port in the wellbore along a selected radial direction for supplying the treatment fluid to the first flow port and a circuit for transmitting a signal corresponding to a signal from the one of the accelerometer and the gyroscope to a remote location; and a module that rotates the second flow port within the second string.

18. A method of treating a formation surrounding a wellbore along a selected radial direction, the method comprising:

placing an inner string within an outer string, the inner string having a flow port that provides an opening that covers a selected segment of radial section of the inner string;

using a sensor of the inner string to determine an orientation of the flow port, wherein the sensor includes one of an accelerator and a gyroscope;

providing a motor configured to rotate the flow port;

providing a control circuit configured to control the motor; and controlling the motor to orient the flow port in response to a signal sent from a surface location or programmed instruction provided to the control circuit for automatically orienting the second flow port along a selected radial direction; and supplying a treatment fluid to the formation through the oriented flow port.

19. The method of claim 18, wherein orienting the flow port along the selected radial direction of the wellbore comprises orienting the flow port along the selected radial direction after placing an outer string into the wellbore.

20. The method of claim 18 further comprising:

providing an orientation sensor on the inner string; and orienting the inner sting in the wellbore from a surface location in response to signals received from the orientation sensor.

* * * * *